US006326736B1

(12) United States Patent
Kang et al.

(10) Patent No.: US 6,326,736 B1
(45) Date of Patent: Dec. 4, 2001

(54) METHOD FOR DRIVING PLASMA DISPLAY PANEL

(75) Inventors: Kyoung-ho Kang, Asan; Jeong-duk Ryeom, Cheonan; Seong-charn Lee, Seoul, all of (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/686,064

(22) Filed: Oct. 11, 2000

(30) Foreign Application Priority Data

Oct. 26, 1999 (KR) ..... 99-46619

(51) Int. Cl.[7] ..... G09G 3/10

(52) U.S. Cl. ..... 315/169.4; 315/169.1; 345/68; 345/90; 345/204

(58) Field of Search ..... 315/169.1, 169.4, 315/169.2; 345/55, 67, 68, 204, 208, 89, 90

(56) References Cited

U.S. PATENT DOCUMENTS 6,184,848 * 2/2001 Weber ..... 345/60

6,271,811 * 8/2001 Shimizu et al. ..... 315/169.1 X

* cited by examiner

*Primary Examiner*—Haissa Philogene
(74) *Attorney, Agent, or Firm*—Leydig, Voit & Mayer, Ltd.

(57) ABSTRACT

A method for driving a plasma display panel having front and rear substrates opposed to and facing each other, X and Y electrode lines between the front and rear substrates parallel to each other and address electrode lines orthogonal to the X and Y electrode lines, to define corresponding pixels at intersections. A scan pulse is applied to the respective Y electrode lines with a predetermined time difference and the corresponding display data signals are simultaneously applied to the respective address electrode lines to form wall charges at pixels for a display discharge and pluses for a display discharge are alternately applied to the X and Y electrode lines to cause a display discharge at the pixels where the wall charges have been formed. Here, the scan pulse is progressively applied to the corresponding Y electrode lines of subfields established as driving periods for a time-division gray scale display, and the scanning order for the subfields changes according to the field, which is a unit display period.

4 Claims, 8 Drawing Sheets

METHOD FOR DRIVING PLASMA DISPLAY PANEL

BACKGROUND OF THE INVENTION

1. Field of the Invention

The present invention relates to a method for driving a plasma display panel, and more particularly, to a method for driving a three-electrode surface-discharge plasma display panel.

2. Description of the Related Art

FIG. 1 shows a structure of a general three-electrode surface-discharge plasma display panel, FIG. 2 shows an electrode line pattern of the panel shown in FIG. 1, and FIG. 3 shows an example of a pixel of the panel shown in FIG. 1. Referring to the drawings, address electrode lines $A_1$, $A_2$, . . . $A_m$, dielectric layers 11 and 15, Y electrode lines $Y_1$, $Y_2$, . . . $Y_n$, X electrode lines $X_1$, $X_2$, . . . , and $X_n$, phosphors 16, partition walls 17 and a MgO protective film 12 are provided between front and rear glass substrates 10 and 13 of a general surface-discharge plasma display panel 1.

The address electrode lines $A_1$, $A_2$, . . . $A_m$ coat the front surface of the rear glass substrate 13 in a predetermined pattern. The lower dielectric layer 15 entirely coats the front surface of the address electrode lines $A_1$, $A_2$, . . . $A_m$. The partition walls 17 on the front surface of the lower dielectric layer 15 are parallel to the address electrode lines $A_1$, $A_2$, . . . $A_m$. The partition walls 17 define discharge areas of the respective pixels and prevent optical crosstalk among pixels. The phosphors 17 coatings are between partition walls 17.

The X electrode lines $X_1$, $X_2$, . . . $X_n$ and the Y electrode lines $Y_1$, $Y_2$, . . . $Y_n$ are arranged on the rear surface of the front glass substrate 10 orthogonal to the address electrode lines $A_1$, $A_2$, . . . $A_m$ in a predetermined pattern. The respective intersections define corresponding pixels. The X electrode lines $X_1$, $X_2$, . . . and $X_n$ and the Y electrode lines $Y_1$, $Y_2$, . . . $Y_n$ are each comprised of conductive indium tin oxide (ITO) electrode lines ($X_{na}$ and $Y_{na}$ of FIG. 3) and metal bus electrode lines ($X_{nb}$ and $Y_{nb}$ of FIG. 3). The upper dielectric layer 11 entirely coats the rear surface of the X electrode lines $X_1$, $X_2$, . . . $X_n$ and the Y electrode lines $Y_1$, $Y_2$, . . . $Y_n$. The MgO protective film 12 for protecting the panel 1 against strong electrical fields entirely coats the rear surface of the upper dielectric layer 11. A gas for forming plasma is hermetically sealed in a discharge space 14.

The above-described plasma display panel is basically driven such that a reset step, an address step and a sustain-discharge step are sequentially performed in a unit subfield. In the reset step, wall charges remaining in the previous subfield are erased and space charges are evenly formed. In the address step, the wall charges are formed in a selected pixel area. Also, in the sustain-discharge step, light is produced at the pixel at which the wall charges are formed in the address step. In other words, if alternating pulses of a relatively high voltage are applied between the X electrode lines $X_1$, $X_2$, . . . $X_n$, and the Y electrode lines $Y_1$, $Y_2$, . . . $Y_n$, a surface discharge occurs at the pixels at which the wall charges are formed. Here, plasma is formed at the gas layer of the discharge space 14 and the phosphors 142 are excited by ultraviolet rays to thus emit light.

FIG. 4 shows a unit frame for displaying gray scales on the plasma display panel shown in FIG. 1 according to the general sequential driving method. Here, a unit display period represents a frame in the case of a progressive scanning method, and a field in the case of an interlaced scanning method. The driving method shown in FIG. 4 is generally referred to as a multiple address overlapping display driving method. According to this driving method, pulses for a display discharge are consistently applied to all X electrode lines $X_1$, $X_2$, . . . $X_n$ and all Y electrode lines $Y_1$, $Y_2$, . . . $Y_n$, and pulses for resetting or addressing are applied between the respective pulses for a display discharge. Here, the pulses for resetting or addressing are applied to the Y electrode lines corresponding to a plurality of subfields $SF_1$, $SF_2$, . . . $SF_8$ set as driving periods for the purpose of displaying gray scales in a time-divisional manner.

Thus, compared to an address-display separation driving method, the multiple address overlapping display driving method has an enhanced displayed luminance. Here, the address-display separation driving method refers to a method in which within a unit subfield, reset and address steps are performed for all Y electrode lines $Y_1$, $Y_2$, . . . $Y_n$, during a certain period and a display discharge step is then performed.

Referring to FIG. 4, a unit field or frame is divided into 8 subfields $SF_1$, $SF_2$, . . . $SF_8$ for achieving a time-division gray scale display. Also, in each subfield, reset, address and sustain-discharge steps are performed, and the time allocated to each sub-field is determined by the display discharge time corresponding to gray scales. For example, in the case of displaying 256 gray scales with 8-bit image data in units of frames, assuming that a unit frame, generally 1/60 sec, consists of 256 unit times, the first subfield $SF_1$ driven by the image data of the least significant bit has 1 ($2^0$) unit time, the second subfield $SF_2$ 2 ($2^1$) unit times, the third subfield $SF_3$ 4 ($2^2$) unit times, the fourth subfield $SF_4$ 8 ($2^3$) unit times, the fifth subfield $SF_5$ 16 ($2^4$) unit times, the sixth subfield $SF_6$ 32 ($2^5$) unit times, the seventh subfield $SF_7$ 64 ($2^6$) unit times, and the eighth subfield $SF_8$ driven by the image data of the most significant bit 128 ($2^7$) unit time, respectively. In other words, since the sum of the unit times allocated to the respective subfields is 255 unit times, it is possible to achieve 255 gray scale display, and 256 gray scale display inclusive of one gray scale in which a no display discharge occurs in any subfield.

If an address step is performed for a Y electrode line and then a display discharge step is performed in the first subfield $SF_1$, an address step is performed for the corresponding Y electrode line at the second subfield $SF_2$. The same procedure is applied to subsequent subfields $SF_3$, $SF_4$, . . . $SF_8$. For example, if an address step is performed for a corresponding Y electrode line and then a display discharge step is performed in the seventh subfield $SF_7$, an address step is performed for the corresponding Y electrode line at the eighth subfield $SF_8$. Although the time for a unit subfield equals the time for a unit field or frame, the respective unit subfields are overlapped on the basis of driven Y electrode lines $Y_1$, $Y_2$, . . . $Y_{480}$ to form a unit field or frame. Thus, since all subfields $SF_1$, $SF_2$, . . . $SF_8$ exist at every timing, time slots for addressing, depending on the number of subfields, are set between the respective display discharge pulses for the purpose of performing the respective address steps.

FIG. 5 shows driving signals in a unit field or frame based on the driving method shown in FIG. 4. In FIG. 5, $S_{y1}$, $S_{y2}$, . . . $S_{y8}$ denote driving signals applied to the corresponding Y electrode lines of the respective subfields. In more detail, $S_{y1}$ denotes a driving signal applied to a Y electrode line of the first subfield ($SF_1$ of FIG. 4), $S_{y2}$ a driving signal applied to a Y electrode line of the second subfield ($SF_2$ of FIG. 4), $S_{y3}$ a driving signal applied to a Y electrode line of the third subfield ($SF_3$ of FIG. 4), $S_{y4}$ a driving signal applied to a Y electrode line of the fourth subfield ($SF_4$ of FIG. 4), $S_{y5}$ a driving signal applied to a Y electrode line of the fifth subfield ($SF_5$ of FIG. 4), $S_{y6}$ a driving signal applied to a Y electrode line of the sixth subfield ($SF_6$ of FIG. 4), $S_{y7}$ a driving signal applied to a Y electrode line of the seventh subfield ($SF_7$ of FIG. 4), and $S_{y8}$ a driving signal applied to a Y electrode line of the eighth subfield ($SF_8$ of FIG. 4), respectively. $S_{X1 \ldots 4}$ and $S_{X5 \ldots 8}$ denote driving signals applied to X electrode line groups corresponding to scanned Y electrode lines, $S_{A1 \ldots m}$ denotes display data signals applied to all address electrode lines ($A_1, A_2, \ldots A_m$ of FIG. 1), and GND denotes a ground voltage.

FIG. 6 shows in more detail driving signals $S_{y1}, S_{y2}, \ldots S_{y8}$ applied to the corresponding Y electrode lines of the respective subfields in time periods $T_{31}$ to $T_{42}$ shown in FIG. 5.

Referring to FIGS. 5 and 6, pulses 2 and 5 for a display discharge are consistently applied to all X electrode lines ($X_1, X_2, \ldots X_n$ of FIG. 1) and all Y electrode lines $Y_1, Y_2, \ldots Y_{480}$, and a reset pulse 3 or a scan pulse 6 are applied between the respective pulses 2 and 5 for a display discharge. Here, the pulses for resetting or addressing are applied to the Y electrode lines corresponding to a plurality of subfields $SF_1, SF_2, \ldots SF_8$.

There exists a predetermined quiescent period until the scan pulse 6 is applied since the reset pulse 3 was applied, so that space charges are smoothly distributed at the corresponding pixel areas. In FIG. 5, time periods $T_{12}$, $T_{21}$, $T_{22}$ and $T_{31}$ denote quiescent periods corresponding to Y electrode line groups of the first through fourth subfields, and time periods $T_{22}$, $T_{31}$, $T_{32}$ and $T_{41}$ denote quiescent periods corresponding to Y electrode line groups of the fifth through eighth subfields. The pulses 5 for a display discharge applied during the respective quiescent periods cannot actually cause a display discharge but allow space charges to be smoothly distributed at the corresponding pixel areas. However, the pulses 2 for a display discharge applied during periods other than the quiescent periods cause a display discharge at the pixels where wall charges have been formed by the scan pulse 6 and the display data signal $S_{A1 \ldots m}$.

Between the last pulses, among the pulses 5 for a display discharge applied during the quiescent periods, and the first pulses 2 for a display discharge, subsequent to the last pulses, addressing is performed four times. For example, addressing is performed for the Y electrode line group corresponding to the first through fourth subfields during a time period $T_{32}$. Also, addressing is performed for the Y electrode line group corresponding to the fifth through eighth subfields during a time period $T_{42}$. As described above with reference to FIG. 4, since all subfields $SF_1$, $SF_2, \ldots SF_8$ exist at every timing, time slots for addressing, depending on the number of subfields, are set between the respective pulses for a display discharge for the purpose of performing the respective address steps.

In the method for driving the 3-electrode surface discharge plasma display panel, conventionally, the scanning order of a plurality of subfields is constant, irrespective of the display period. For example, in the first subfield $SF_1$ and the fifth subfield $SF_5$, scanning is always done at the first time slot. Also, in the second subfield $SF_2$ and the sixth subfield $SF_6$, scanning is always done at the second time slot. Likewise, in the third subfield $SF_3$ and the seventh subfield $SF_7$, scanning is always done at the third time slot. In the fourth subfield $SF_4$ and the eighth subfield $SF_8$, scanning is always done at the fourth time slot.

However, the standby times required for wall charges which have been formed on the respective Y electrode lines by addressing to wait for the pulses ($T_{31}$ of FIG. 5 or 2 in the time period $T_{41}$) are different. As the standby time becomes longer, much more wall charges which have been formed at the pixels to be displayed are lost. According to the conventional driving method, it is quite highly probable that pixels to be displayed at subfields having the first scanning time slot, for example, the first subfield $SF_1$ and the fifth subfield $SF_5$, are consistently displayed. Thus, uniformity and stability of a display may be deteriorated.

SUMMARY OF THE INVENTION

To solve the above problem, it is an object of the present invention to provide a method for driving a plasma display panel which can increase the uniformity and stability of a display by preventing a phenomenon in which a display discharge does not occur consistently at to-be-displayed pixels of a specific subfield.

Accordingly, to achieve the above object, there is provided a method for driving a plasma display panel having front and rear substrates opposed to and facing each other, X and Y electrode lines formed between the front and rear substrates to be parallel to each other and address electrode lines formed to be orthogonal to the X and Y electrode lines, to define corresponding pixels at interconnections, such that wherein a scan pulse is applied to the respective Y electrode lines with a predetermined time difference and the corresponding display data signals are simultaneously applied to the respective address electrode lines to form wall charges at pixels to be displayed and pluses for a display discharge are alternately applied to the X and Y electrode lines to cause a display discharge at the pixels where the wall charges have been formed. Here, the scan pulse is progressively applied to the corresponding Y electrode lines of a plurality of subfields set as driving periods for time-divisional gray scale display, and the scanning order for the plurality of subfields changes according to the field which is a unit display period.

Therefore, since a phenomenon in which a display discharge does not occur consistently at to-be-displayed pixels of a specific subfield is prevented by a change in the scanning order of the respective subfields, the uniformity and stability of a display can be increased.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

The basic driving method according to this embodiment is the same as described above in the Description of the Related Art. Thus, only the feature of the present invention will now be described.

The following Table 1 shows the addressing order according to two embodiments of the present invention.

TABLE 1

| | Scanning position | | | |
|---|---|---|---|---|
| | Odd frame | | Even frame | |
| Embodiment | Odd field | Even field | Odd field | Even field |
| First embodiment | 1→2→3→4 | 3→4→1→2 | 1→2→3→4 | 3→4→1→2 |
| Second embodiment | 1→2→3→4 | 3→4→1→2 | 2→1→4→3 | 4→3→2→1 |

Figure 1:
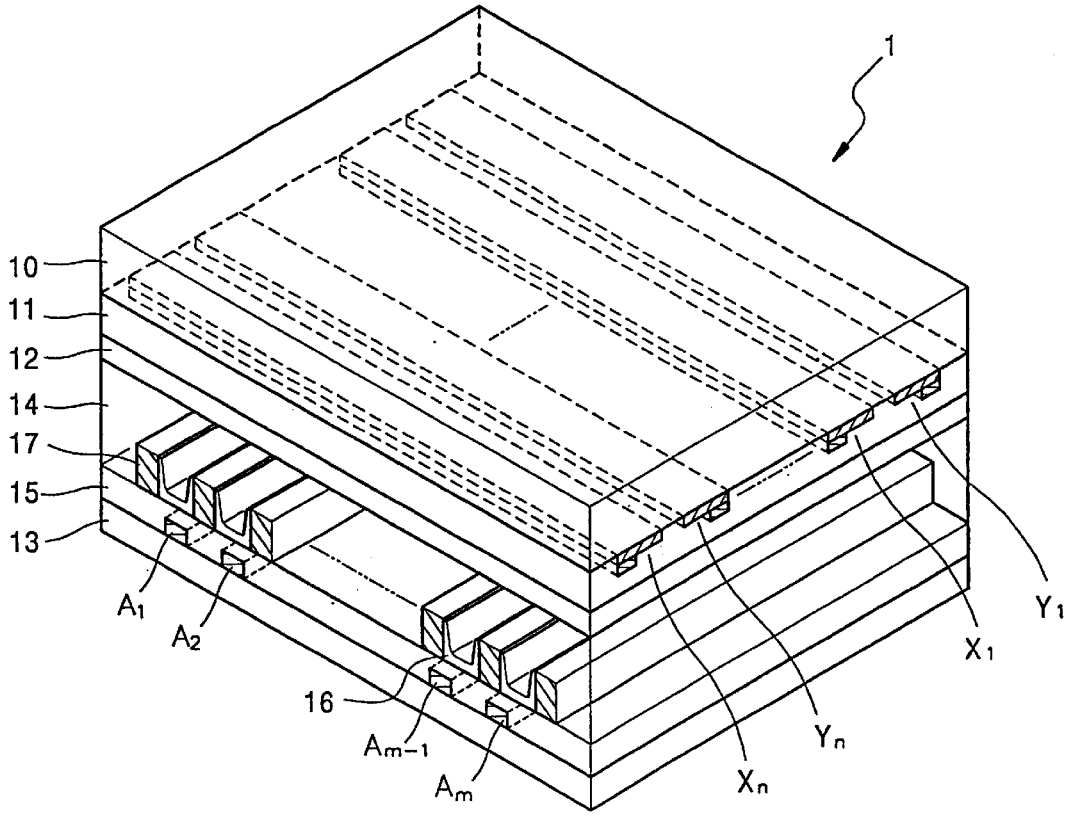
FIG. 1 PRIOR ART
FIG. 1 shows an internal perspective view illustrating a structure of a general three-electrode surface-discharge plasma display panel.
Figure 2:
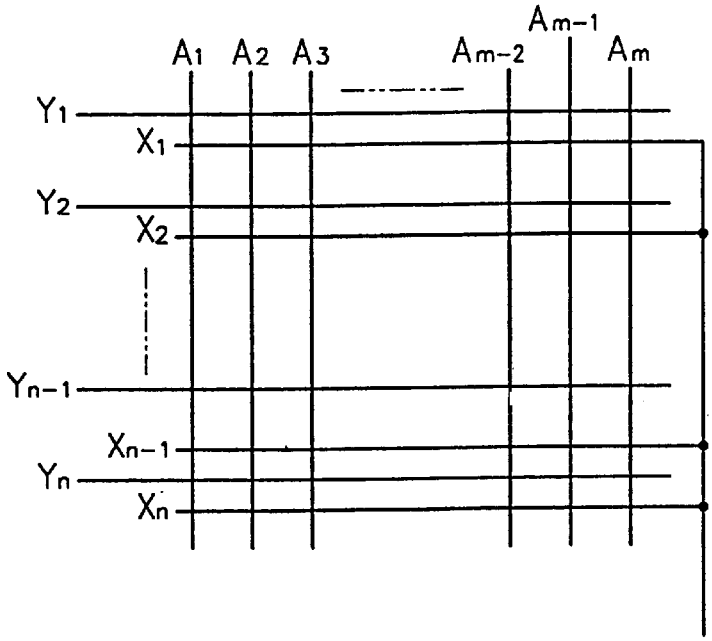
FIG. 2 PRIOR ART
FIG. 2 shows an electrode line pattern of the panel shown in FIG. 1.
Figure 3:
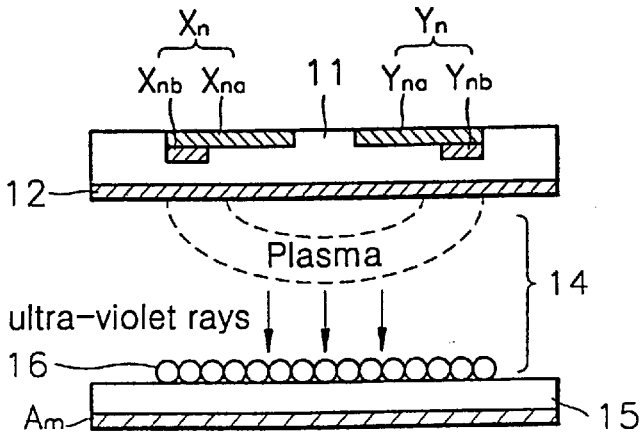
FIG. 3 PRIOR ART
FIG. 3 is a cross section of an example of a pixel of the panel shown in FIG. 1.
Figure 4:
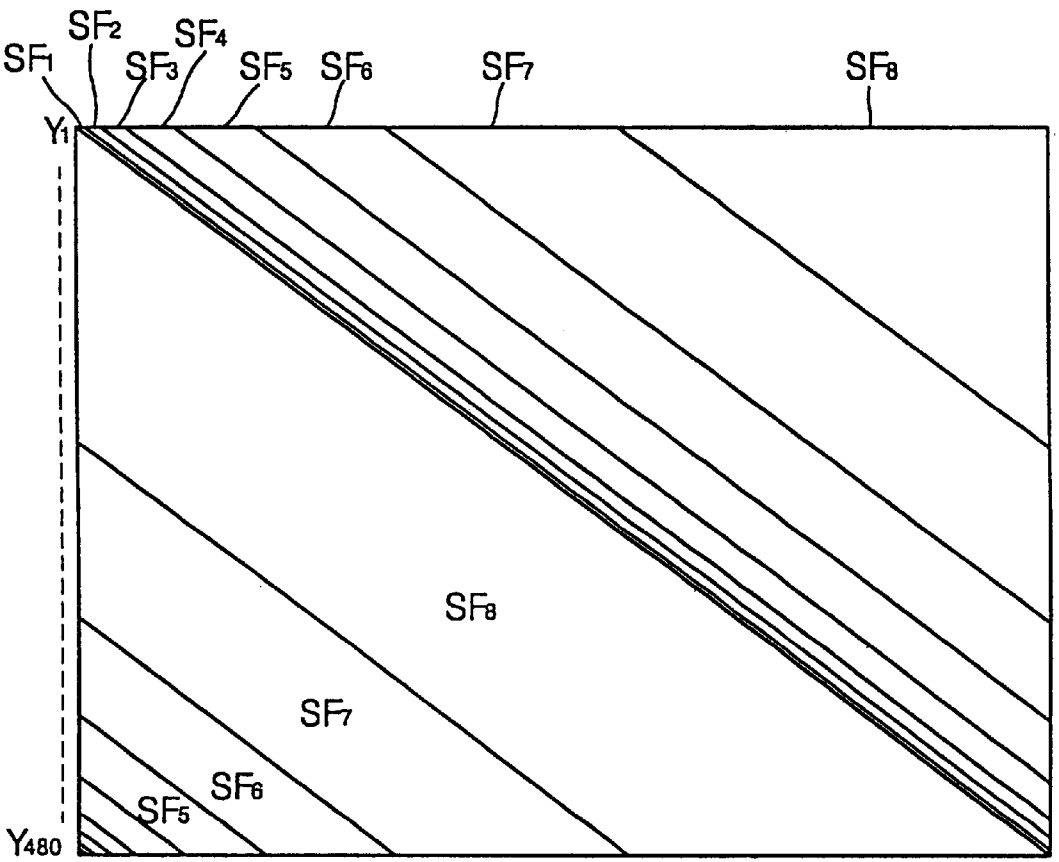
FIG. 4 PRIOR ART
FIG. 4 is a timing diagram showing the structure of a unit display period based on the driving method of a general plasma display panel.
Figure 5:
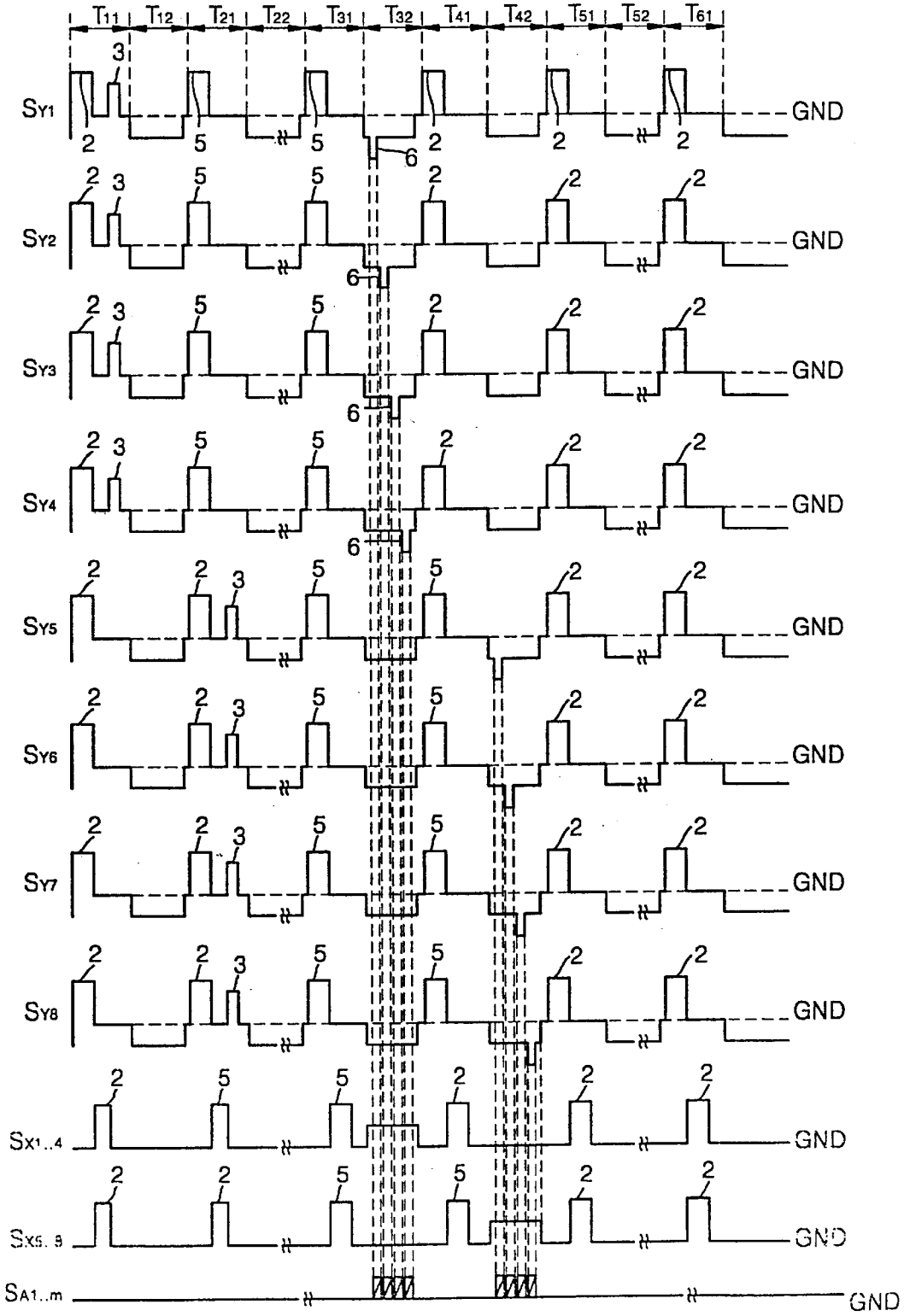
FIG. 5 PRIOR ART
FIG. 5 is a waveform diagram of driving signals in a unit field or frame based on the driving method shown in FIG. 4.

In Table 1, the expression "1→2→3→4" means that scanning is done at the first time slot in the first subfield ($SF_1$ of FIG. 4) and the fifth subfield ($SF_5$ of FIG. 4), at the second time slot in the second subfield ($SF_2$ of FIG. 4) and the sixth subfield ($SF_6$ of FIG. 4), at the third time slot in the third subfield ($SF_3$ of FIG. 4) and the seventh subfield ($SF_7$ of FIG. 4), and at the fourth time slot in the fourth subfield ($SF_4$ of FIG. 4) and the eighth subfield ($SF_8$ of FIG. 4). Referring to Table 1, in both the first and second embodiments, the scanning order for each subfield is changed in units of fields. In the first embodiment, the scanning order for the respective subfields alternately changes in units of an odd field and an even field within a unit frame. This scanning order does not change according to the order of frames. However, in the second embodiment, the scanning order for the respective subfields alternately changes in units of an odd field and an even field within a unit frame, while alternately changing in units of an odd frame and an even frame. According to the first and second embodiments, a phenomenon in which a display discharge does not occur consistently at to-be-displayed pixels of a specific subfield by changing the scanning order of the respective subfields, thereby increasing the uniformity and stability of a display.

Figure 6:
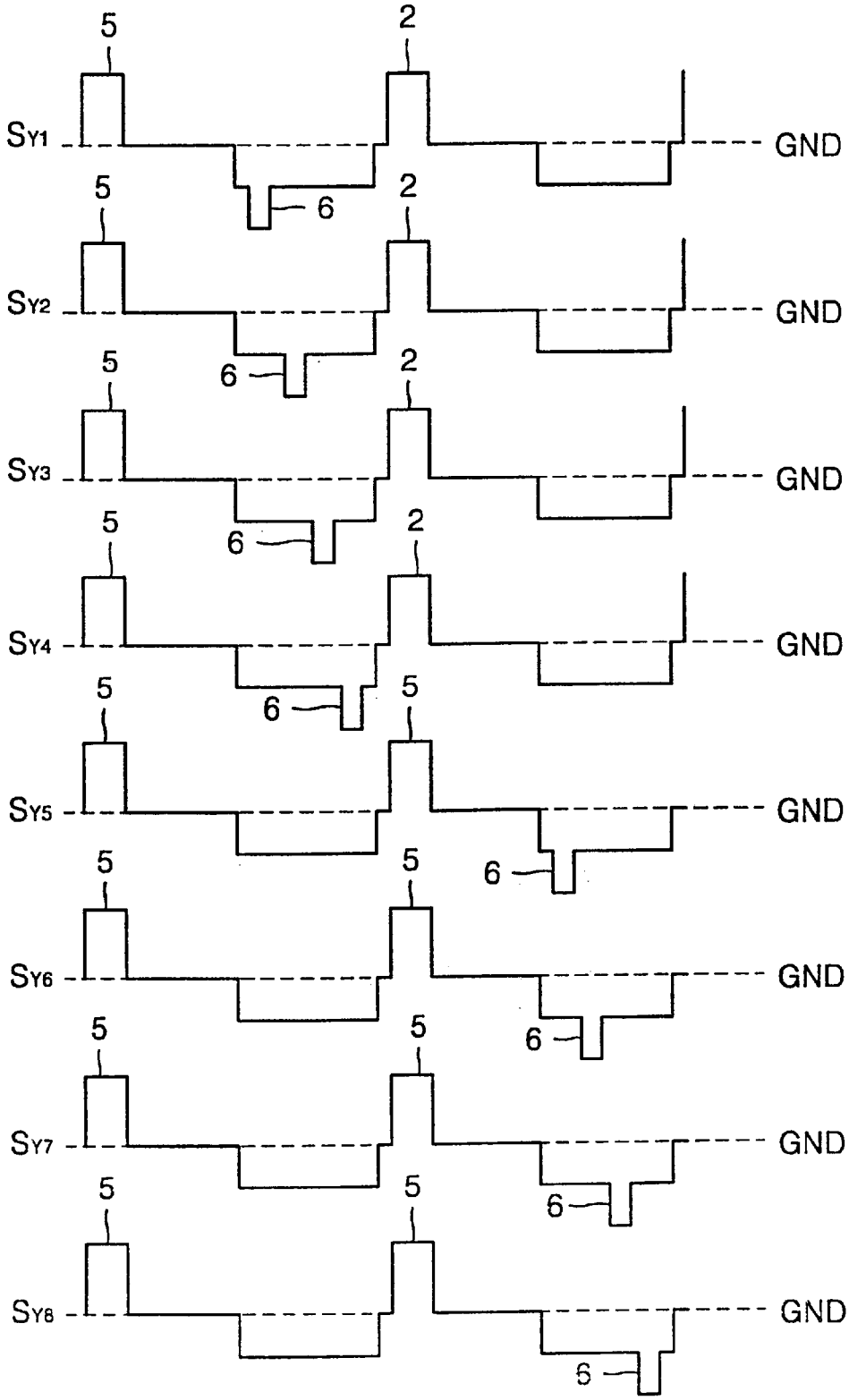
FIG. 6 PRIOR ART
FIG. 6 is a detailed waveform diagram of driving signals applied to corresponding Y electrode lines of the respective subfields during periods $T_{31}$ to $T_{42}$ shown in FIG. 5.

The driving timing diagram for the scanning order of "1→2→3→4" in the first and second embodiments is shown in FIG. 6.

Figure 7:
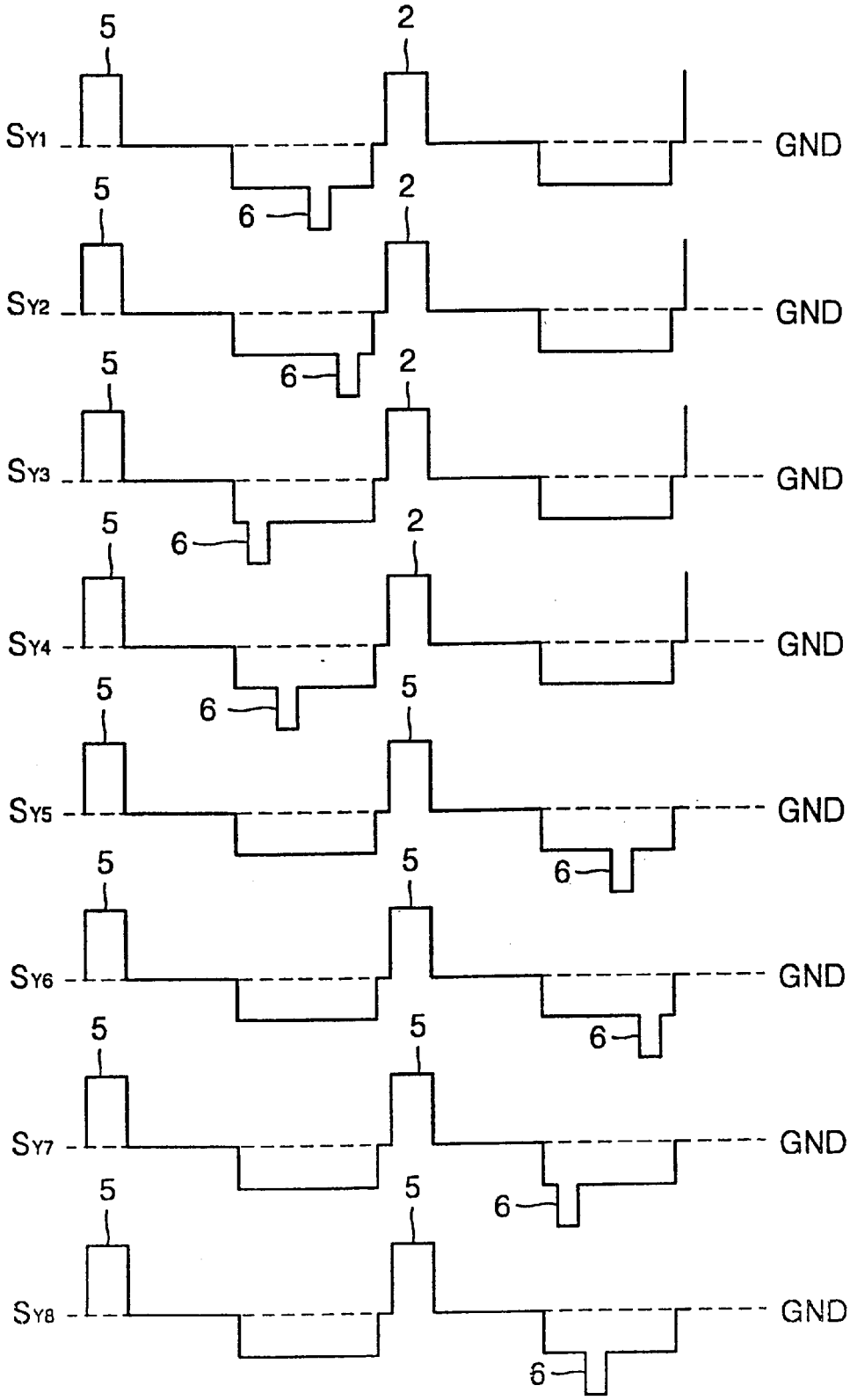
FIG. 7 is a detailed waveform diagram of driving signals applied to corresponding Y electrode lines of the respective subfields in an address step of the second fields of the respective frames according to a first embodiment of the present invention.

FIG. 7 is a detailed waveform diagram of driving signals applied to corresponding Y electrode lines of the respective subfields in an address step of the second fields of the respective frames according to the first embodiment of the present invention, as shown in Table 1. In FIG. 7, the same reference numerals denote the same functional element as shown in FIG. 6. Referring to FIG. 7, according to the second embodiment shown in Table 1, in the address step of the second fields of the respective frames, scanning is done at the third time slot in the first subfield $SF_1$ and the fifth subfield $SF_5$, at the fourth time slot in the second subfield $SF_2$ and the sixth subfield $SF_6$, at the first time slot in the third subfield $SF_3$ and the seventh subfield $SF_7$, and at the second time slot in the fourth subfield $SF_4$ and the eighth subfield $SF_8$.

The waveform diagram shown in FIG. 7 corresponds to the scanning order of "3→4→1→2" in the first and second embodiments, that is, the address step of the even fields of the odd frame in the first embodiment and the address step of the even fields of the odd frame in the second embodiment.

Figure 8:
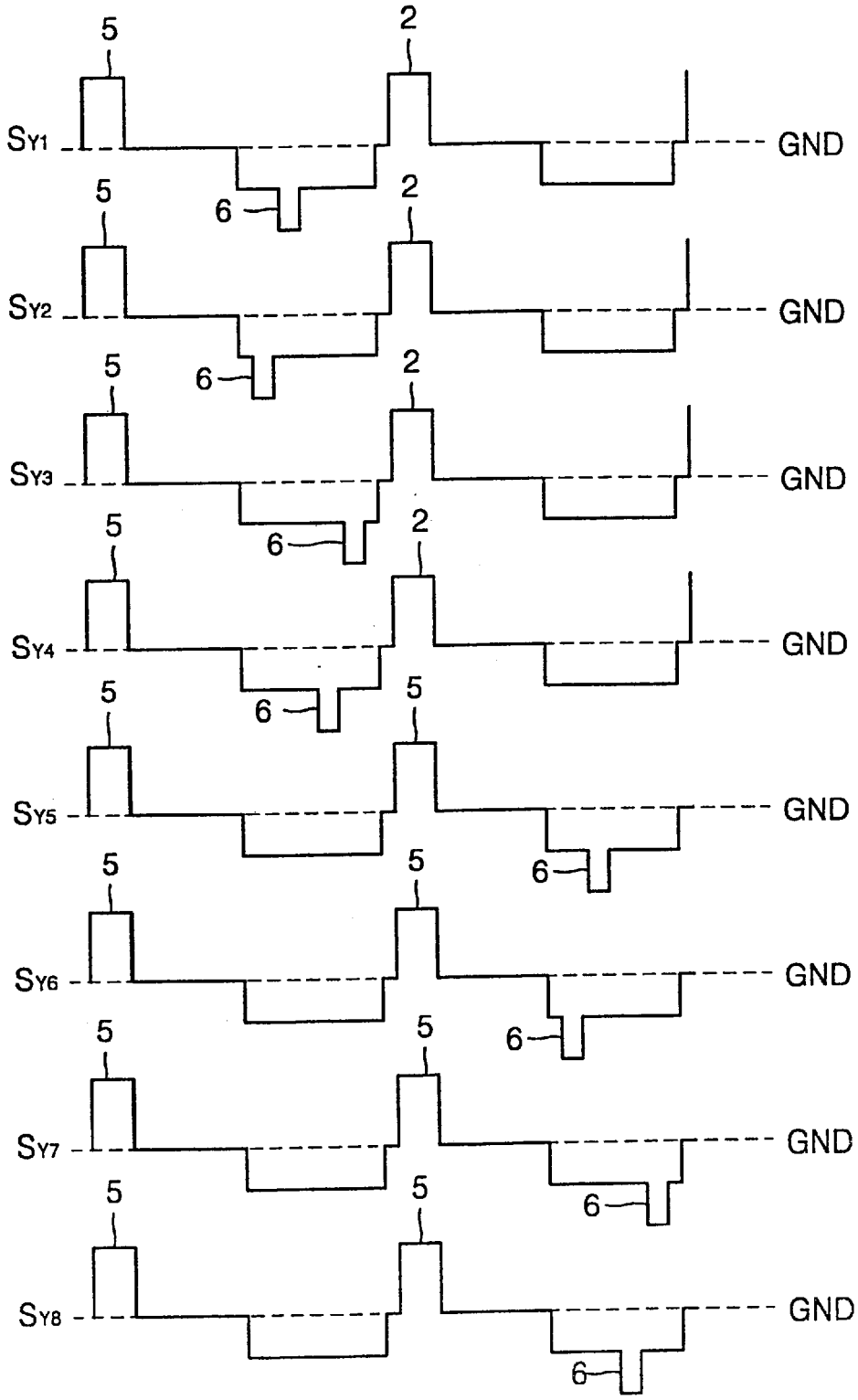
FIG. 8 is a detailed waveform diagram of driving signals applied to corresponding Y electrode lines of the respective subfields in an address step of the first fields of the even frames according to a second embodiment of the present invention.

FIG. 8 is a detailed waveform diagram of driving signals applied to corresponding Y electrode lines of the respective subfields in an address step of the first fields of the even frames according to the second embodiment of the present invention, as shown in Table 1. In FIG. 8, the same reference numerals denote the same functional element as shown in FIG. 7. Referring to FIG. 8, according to the second embodiment shown in Table 1, in the address step of the first fields of the even frames, scanning is done at the second time slot in the first subfield $SF_1$ and the fifth subfield $SF_5$, at the first time slot in the second subfield $SF_2$ and the sixth subfield $SF_6$, at the fourth time slot in the third subfield $SF_3$ and the seventh subfield $SF_7$, and at the third time slot in the fourth subfield $SF_4$ and the eighth subfield $SF_8$.

Figure 9:
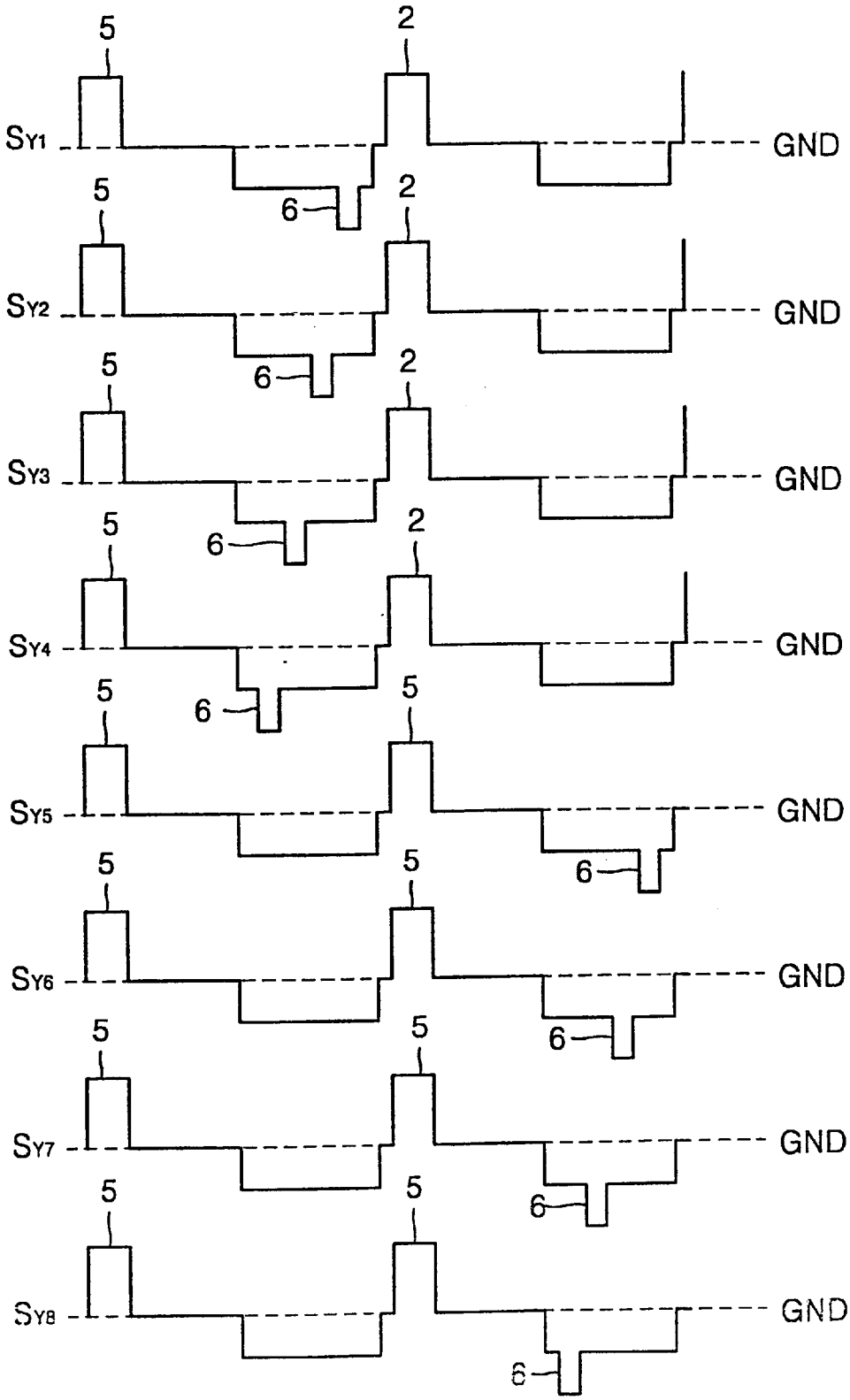
FIG. 9 is a detailed waveform diagram of driving signals applied to corresponding Y electrode lines of the respective subfields in an address step of the second fields of the even frames according to a second embodiment of the present invention.

FIG. 9 is a detailed waveform diagram of driving signals applied to corresponding Y electrode lines of the respective subfields in an address step of the second fields of the even frames according to the second embodiment of the present invention, as shown in Table 1. In FIG. 9, the same reference numerals denote the same functional element as shown in FIG. 8. Referring to FIG. 9, according to the second embodiment shown in Table 1, in the address step of the second fields of the even frames, scanning is done at the fourth time slot in the first subfield $SF_1$ and the fifth subfield $SF_5$, at the third time slot in the second subfield $SF_2$ and the sixth subfield $SF_6$, at the second time slot in the third subfield $SF_3$ and the seventh subfield $SF_7$, and at the first time slot in the fourth subfield $SF_4$ and the eighth subfield $SF_8$.

As described above, in the method for driving a plasma display panel method according to the present invention, a phenomenon in which a display discharge does not occur consistently at to-be-displayed pixels of a specific subfield can be prevented by changing the scanning order of the respective subfields, thereby increasing the uniformity and stability of a display.

Although the invention has been described with respect to a preferred embodiment, it is not to be so limited as changes and modifications can be made which are within the full intended scope of the invention as defined by the appended claims.

What is claimed is:

1. A method for driving a plasma display panel having front and rear substrates opposed to and facing each other, X and Y electrode lines between the front and rear substrates parallel to each other, and address electrode lines orthogonal to the X and Y electrode lines, defining corresponding pixels at intersections, wherein a scan pulse is applied to respective Y electrode lines with a time difference and corresponding display data signals are simultaneously applied to respective address electrode lines to form wall charges at pixels at which light is to be displayed, and pulses for producing a display discharge are alternately applied to the X and Y electrode lines to cause a display discharge at the pixels where the wall charges have been formed, the driving method including applying the scan pulse progressively to the corresponding Y electrode lines of a plurality of sub fields established as driving periods for a time-division gray scale display, and changing the scanning order for the plurality of subfields according to the field in a unit display period.

2. The method according to claim 1, wherein the scanning order for the plurality of subfields alternately changes in units of an odd field and an even field.

3. The method according to claim 2, wherein the scanning order for the plurality of subfields changes in units of a frame which is a display period consisting of an odd field and an even field.

4. The method according to claim 3, wherein the scanning order for the plurality of subfields alternately changes in units of an odd frame and an even frame.

* * * * *